United States Patent [19]

Georgiev et al.

[11] 4,148,484

[45] Apr. 10, 1979

[54] SOCCER GAME

[76] Inventors: Slavi A. Georgiev; Dimitraki J. Stojnov, both of 10263 Pleasant Ave. S., Bloomington, Minn. 55420

[21] Appl. No.: 871,031

[22] Filed: Jan. 20, 1978

[51] Int. Cl.[2] ..... A63F 7/06

[52] U.S. Cl. ..... 273/85 R; 273/85 E; 273/119 R; 273/129 HB

[58] Field of Search ..... 273/85 R, 85 E, 85 B, 273/119 R, 129 HB

[56] References Cited

U.S. PATENT DOCUMENTS

| | | | |
|---|---|---|---|
| 3,086,778 | 4/1963 | Maurer | 273/85 E |
| 3,204,965 | 9/1965 | Engle | 273/119 R |
| 3,214,171 | 10/1965 | Lochsinger | 273/85 R |
| 3,901,508 | 8/1975 | Spangler | 273/85 E X |

FOREIGN PATENT DOCUMENTS

| | | | |
|---|---|---|---|
| 510462 | 3/1955 | Canada | 273/85 B |
| 2331946 | 1/1974 | Fed. Rep. of Germany | 273/85 B |
| 642939 | 7/1962 | Italy | 273/85 E |
| 201400 | 8/1923 | United Kingdom | 273/85 B |

*Primary Examiner*—Paul E. Shapiro

*Attorney, Agent, or Firm*—Merchant, Gould, Smith, Edell, Welter & Schmidt

[57] ABSTRACT

A simulated soccer game comprising a base member having a playing surface thereon, a plurality of playing elements, each of the elements having an object striking portion and a device positioned above and supported by the base member for independently mounting each of the playing elements for pivotal movement about a point so that the striking portion of the playing element is movable radially in any direction from a longitudinal axis extending from said point and being generally perpendicular to the playing surface.

9 Claims, 3 Drawing Figures

FIG. 1
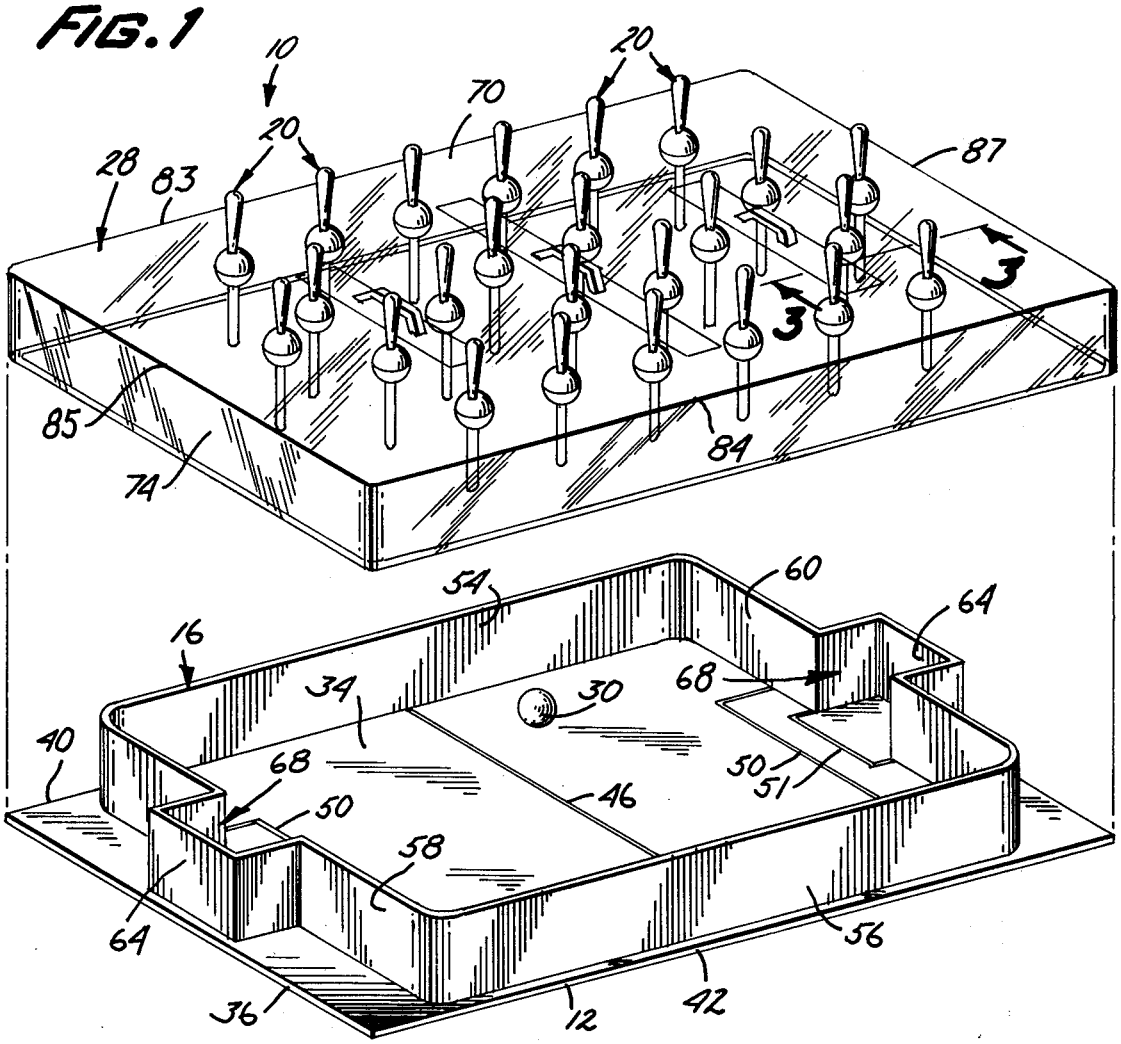
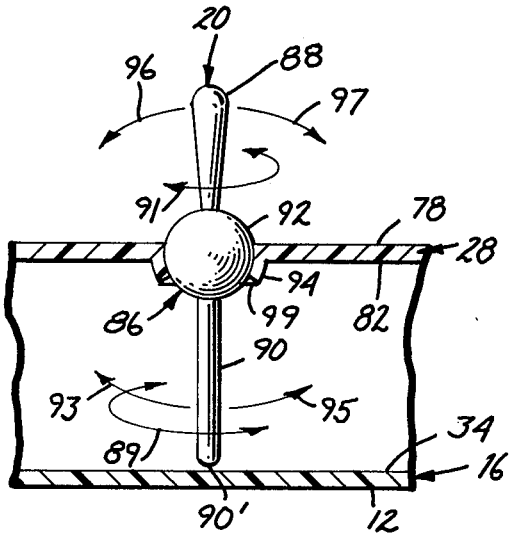
FIG. 2
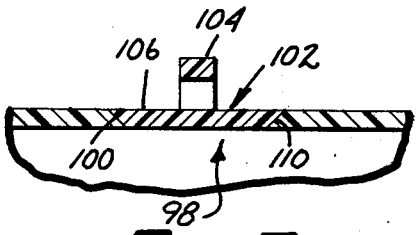
FIG. 3

SOCCER GAME

BACKGROUND OF THE INVENTION

This invention relates to games, in particular a game for simulating soccer or the like.

It is known in the art to make simulated games which generally comprise a game board having a playing surface, a plurality of rods for mounting the playing elements, the rods being spaced in a parallel fashion and being rotatably mounted above the playing surface. The rods are rotatable about axes disposed in a plane parallel to the playing surface. Each rod has a plurality of playing elements that are therefore rotatable in planes normal to the playing surface. The rods may be moved transversely along their rotational axes. A goal or scoring pocket is also usually provided in each end wall of the playing board. By rotating the rods, the playing elements mounted thereon strike some sort of object, usually a ball, so that the object may be advanced over the playing board and so that goals may be scored. One major disadvantage of the above-described game is that each playing element cannot be individually operated so that the ball or object can be passed or moved in any of a number of directions.

SUMMARY OF THE INVENTION

Applicants' invention is a new and useful game for simulating soccer and the like which can be manufactured out of easily available and inexpensive materials. Applicants' simulated game has a plurality of playing elements, each of the playing elements being independently operable with respect to any other playing element so that a ball or object may be passed in any of a number of directions.

Applicants' invention generally comprises a base member having a playing surface thereon, a plurality of playing elements, each of the playing elements having an object striking portion and a manual actuating portion, and means positioned above and supported by the base member for independently mounting each of the playing elements for pivotal movement about a point so that the striking portion is movable radially in any direction from a longitudinal axis extending through the point, the longitudinal axis being generally perpendicular to the playing surface.

BRIEF DESCRIPTION OF THE DRAWING

FIG. 1 is a partially exploded view of the simulated game in perspective;

FIG. 2 is an enlarged fragmentary elevational view of the simulated game which illustrates the movement of one of the playing elements; and FIG. 3 is an enlarged fragmentary sectional view taken along line 3—3 of FIG. 1.

DETAILED DESCRIPTION OF THE PREFFERED EMBODIMENT

Referring now to the drawing, FIG. 1 shows a simulated soccer game generally designated as 10. Game 10 comprises a rectangular base member 12, a generally rectangular playing field enclosure or frame 16, which is mounted on the base member by suitable means, a plurality of playing elements 20, a playing element support member generally designated as 28 which encloses frame 16 and is supported by base member 12 and a ball or playing object 30.

Base member 12 comprises a planar playing surface 34, first and second ends 36 and 38 and opposite side edges 40 and 42. Playing surface 34 may be suitably marked so as to simulate a soccer game or the like. As shown in FIG. 1, playing surface 34 has been marked with a center line 46 and lines generally designated as 50 and 51 which define the penalty area and goal box respectively. The playing surface may be of a felt or cloth material.

Frame 16 comprises a pair of opposite side walls 54 and 56 and a pair of opposite end walls 58 and 60. At approximately the middle of each end wall, a generally rectangular scoring pocket or goal 64 extends outwardly from the end wall and defines a goal mouth 68.

As shown in FIGS. 1 and 2, in the preferred embodiment playing element support member 28 comprises a planar top member 70 made of suitable transparent material such as plastic, and a support frame or member 74 to which the top member is affixed. Support member 74 encloses frame 16 and rests upon and is secured to base member 12 by any suitable means so that top member 70 is spaced from and generally in a plane parallel to playing surface 34. Top member 70 comprises side edges 83 and 84, a front edge 85, a back edge 87, a planar outer surface 78 and a planar inner surface 82. A plurality of holes 86 are formed in top member 70. Holes 86 are generally circular and are sized to receive playing elements 20.

As shown in FIG. 2, each playing element 20 generally comprises an elongated handle member 88, an elongated object striking member 90, and a spherical member 92 which joins handle member 88 and striking member 90. Handle member 88 and striking member 90 are aligned along a longitudinal axis so as to define an axis of elongation. Spherical member 92 of each playing element is received within one of holes 86. An annular, generally circular flange or skirt portion 94 extends downwardly from inner surface 82 at each hole 86 so that spherical member 92 can be freely and pivotally seated within hole 86. Handle member 88 extends above top member 70 while object striking member 90 extends below member 70, the tip of member 90 being sufficiently spaced away from playing surface 34 so that movement of playing element 20 is unrestricted. Normally the axis of elongation of playing elements 20 are perpendicular to playing surface 34.

The bottom of portion 94 may be scooped out or beveled as indicated at 99. It is understood that support means other than top member 70 could be provided for elements 20 within the spirit and scope of the present invention.

As shown by arrows 89 and 91 in FIG. 2, playing element 20 can rotate about the perpendicular alignment of its axis of elongation. Also, as shown by arrows 93 and 95, striking member 90 can be moved in any 360° radial direction away from the perpendicular alignment of axis of elongation when handle 88 is moved or pushed by the user's hand or finger as shown by arrows 96 and 97. The area within which striking member 90 can sweep during its movement can be described as generally conical, the cne having its apex point located along the axis of elongation and within spherical member 92, the cone further having a base defined at an outer end 90' of striking member 90. Holes 86 are spaced apart and elements 20 sized so that in the preferred embodiment ball 30 cannot assume a position on playing surface 34 that is unreachable by at least one of playing elements 20.

As shown in FIGS. 1 and 3, a plurality of elongated rectangular apertures 98 can be formed in top member 70 between selected rows of holes 86 so that object 30 can be inserted and removed. As shown particularly in FIG. 3, the edges 100 of apertures 98 are inclined inwardly from outer surface 78 to inner surface 82. A closure 102 is provided for each of the apertures 98. Closure 102 generally comprises a U-shaped handle 104 and a rectangular base member 106 to which handle 104 is secured. The edges 108 of base member 106 are also inclined so that it will seat within aperture 98. The apertures 98 disposed near goal mouths 68 are utilized for placement of ball 30 for penalty kicks in accordance with the rules of the game. Aperture 98 disposed at center line 46 is utilized for placement of ball 30 for center kicks to begin the game or after goals and other stoppage of play.

In playing the game, the playing elements may be colored by means known in the art so as to divide the playing elements into two teams. The playing elements may be set up in any fashion desired. For instance, the playing elements of one team may be set up on one side of center line 46 while the playing elements of the other team are set up on the other side of center line 46. However, it may be desirable to set up the playing elements so that there are alternating rows of playing elements from each team. It is also preferable that one of the holes 86 and associated element 20 should be placed in top member 70 so that a playing element may be positioned so as to defend each goal mouth 68. As previously described each playing element 20 can be manipulated in any radial direction with respect to a normal perpendicular alignment of its axis of elongation to strike and propel ball 30 in any such direction from element 20. Passes diagonally across playing surface 34 can thus be made from one element 20 to another. Each element 20 is independently movable with respect to every other element 20 thereby allowing for unlimited combinations of passes and shots on goal. It is contemplated that a small table game version of the prevent invention could be made whereby the players would manipulate handle 88 with their fingers. In a larger version for commercial establishments, handles 88 will be sized for grasping with the hands.

From the foregoing, it is apparent that applicants have invented a novel and inexpensive game for simulating soccer and the like in which each of the playing elements may be individually operated.

What is claimed is:

1. A simulated soccer game, comprising:
a base member having a playing surface thereon;
a transparent top member;
means for mounting said top member above said playing surface;
a plurality of playing elements, each of said playing elements having an object striking portion extending below said top member and a manual actuating portion extending above said top member; and
means for independently mounting each of said playing elements in said top member for pivotal movement about a point so that said striking portion of each of said playing elements is movable radially in any direction from a longitudinal axis extending through said point generally perpendicular to said playing surface.

2. A simulated soccer game according to claim 1 further comprising a frame member mounted on said base member and having a pair of opposed side walls and a pair of opposed end walls, each of said end walls having a scoring pocket formed therein, said frame member defining an enclosed playing area on said playing surface.

3. A simulated soccer game according to claim 2 wherein said top member mounting means comprises pairs of opposed end and side walls connected to said top member extending downwardly and surrounding said frame and supported on said base member.

4. A simulated soccer game according to claim 1 wherein said top member has a plurality of spaced, generally circular holes formed therein, each of said playing elements further comprises a ball member connecting said object striking portion and said manual actuating portion, said ball member pivotally mounted within one of said holes.

5. A simulated soccer game, comprising:
a base member having a playing surface thereon;
a plurality of playing elements, each of said playing elements having an elongated object striking member and an elongated handle member; and
means positioned above and supported by said base member for independently mounting each of said playing elements for pivotal movement about a point so that said striking member is movable radially in any direction from longitudinal axis through said pivot point of playing element, said longitudinal axis being substantially perpendicular to said playing surface.

6. A simulated soccer game according to claim 5 wherein said playing element mounting means comprises a generally planar top member having a plurality of holes formed therein in which said playing elements are independently mounted.

7. A simulated soccer game according to claim 6 wherein each of said playing elements further comprises a spherical member connecting said striking member and said handle member, said striking member and said handle member being aligned along an elongation axis, said spherical member being seated within one of said holes.

8. A simulated soccer game according to claim 6 wherein a plurality of elongated apertures are formed in said top member between said holes.

9. A simulated soccer game according to claim 8 further comprising a plurality of closure members having an elongated base member and a handle member attached to said base member, said base member of each of said closure members being removably seated within one of said apertures to provide access to said playing surface.

* * * * *